US007834776B2

(12) United States Patent
Edwards et al.

(10) Patent No.: US 7,834,776 B2
(45) Date of Patent: Nov. 16, 2010

(54) RFID LINKING DEVICE-BASED SWITCHABLE SENSOR, COMPONENT WITH SWITCHABLE SENSOR, AND SYSTEM FOR DETECTING COMPONENT UNSEATED

(75) Inventors: Mark Joseph Edwards, Lexington, KY (US); Ricky Robbins, Danville, KY (US)

(73) Assignee: Lexmark International, Inc., Lexington, KY (US)

( * ) Notice: Subject to any disclaimer, the term of this patent is extended or adjusted under 35 U.S.C. 154(b) by 289 days.

(21) Appl. No.: 12/024,298

(22) Filed: Feb. 1, 2008

(65) Prior Publication Data

US 2009/0195364 A1 Aug. 6, 2009

(51) Int. Cl.
*G08B 21/00* (2006.01)

(52) U.S. Cl. ..... 340/686.1; 340/572.1; 340/572.2; 340/572.3; 340/572.4; 340/572.5; 340/10.1; 340/10.2; 340/10.3; 340/10.4; 340/10.5; 235/385

(58) Field of Classification Search ..... 340/686.1, 340/572.1–572.9, 10.1–10.5; 235/385
See application file for complete search history.

(56) References Cited

U.S. PATENT DOCUMENTS 3,713,148 A 1/1973 Cardullo
4,384,288 A 5/1983 Walton
5,997,121 A 12/1999 Altfather et al.
6,467,869 B1 10/2002 Merz et al.
6,739,689 B2 5/2004 Choi
6,805,430 B2 10/2004 Chen et al.
7,125,109 B2 10/2006 Watanabe et al.
7,157,727 B2 1/2007 Kimura
2006/0139159 A1* 6/2006 Lee et al. ..... 340/457
2007/0008107 A1* 1/2007 Farrell et al. ..... 340/539.1
2007/0040876 A1 2/2007 Anderson et al.
2008/0094226 A1* 4/2008 O'Shea et al. ..... 340/573.1

* cited by examiner

*Primary Examiner*—Davetta W Goins
*Assistant Examiner*—Ojiako Nwugo

(57) ABSTRACT

A RFID linking device-based switchable sensor can be used to detect an unseated condition of one component with another component. The switchable sensor includes a RFID linking device, such as a RFID tag, with an electrical circuitry mountable on the one component and a switchable device incorporated with two portions of the electrical circuitry physically and electrically separated from one another such that the switchable device is exposed and normally in a first condition disabling the RFID linking device to a communicatively unavailable state. The switchable device is accessible from externally of the switchable sensor and thus switchable to a second condition, due to contact with an actuator element on the other component, enabling the RFID linking device to a communicatively available state in response to the one component being placed in the seated condition with the other component.

20 Claims, 5 Drawing Sheets

RFID LINKING DEVICE-BASED SWITCHABLE SENSOR, COMPONENT WITH SWITCHABLE SENSOR, AND SYSTEM FOR DETECTING COMPONENT UNSEATED

BACKGROUND

1. Field of the Invention

The present invention relates generally to detecting an unseated condition of a component and, more particularly, to a RFID linking device-based switchable sensor, a component having the switchable sensor, and a switchable sensor system for detecting a component with the switchable sensor in an unseated condition with respect to another component.

2. Description of the Related Art

A conventional inkjet printing system forms an image on a print medium by ejecting ink from a plurality of ink jetting nozzles of an inkjet printhead to form a pattern of ink dots on the print medium. Inkjet printing is accomplished without contact between the printing system and the print medium. Such printing system also typically includes one or more items that may be replaced once fully consumed during the printing operation. One such consumable item is a semi-permanent inkjet printhead itself and another is a replaceable ink container or tank in which ink is stored. In one embodiment of such inkjet printing system, the semi-permanent printhead is mounted by a reciprocating carrier where at least one replaceable tank when seated within the carrier is engaged in a sealed ink supplying or delivery relationship with the printhead. Once seated, the carrier transports the semi-permanent printhead and the replaceable tank across the print medium along a bi-directional scanning path defining a print zone of the printer. A sheet feeding mechanism is used to incrementally advance a sheet of the print medium in a feed direction, also commonly referred to as a sub-scan direction, through the print zone between scans in the main scan direction, or after all data intended to be printed on the print medium at a particular stationary position has been completed.

Thus, an inkjet printing system including a semi-permanent printhead and a replaceable ink tank is well known. One such inkjet printing system is marketed by Lexmark International, Inc. wherein the at least one ink tank used by the system when fully installed and seated within the reciprocating carrier interfits, in a seated ink delivery relationship, with the semi-permanent printhead mounted by the carrier below the ink tank. An overriding constraint in the design of this inkjet printing system is that costs be kept to a minimum. Only the minimum mechanical physical connections, and ink storage and plumbing requirements are provided. Any added electronics or similar devices are generally not desirable due to their added costs.

In this prior art Lexmark inkjet printing system, then, at least one replaceable ink tank is utilized and also a carrier is utilized for receiving and seating the ink tank. The carrier has a latch or retaining clip which releasably snap fits with the ink tank when the tank is seated within the carrier and interfitted with the printhead. However, one undesirable tradeoff in achieving the overriding cost constraint in the design of this inkjet printing system has been that there is no means provided for automatic detecting that the ink tank is not fully inserted and seated within the carrier so as to be properly engaged and interfitted with the semi-permanent printhead. FIGS. 2-4 show prior art sequences of successive positions of a tank relative to a carrier and printhead, ranging from the tank in an unseated position in FIG. 2, to next the tank almost in the seated position in FIG. 3, to finally the tank in the seated position in the carrier in FIG. 4. If it is not fully intermitted in the sealed ink delivery relationship with the semi-permanent printhead as seen in FIG. 4, the tank will not operate properly and may leak, causing machine damage. Also, depending on the carrier design and machine cover design around the carrier and tank loading area, damage might result from the tank hitting the machine covers.

Previous approaches to detecting presence/absence, misplacement, or seating of a tank or cartridge in the carrier are known in the prior art. Representative of the prior art are the following patents.

U.S. Pat. No. 5,997,121 to Altfather et al. discloses a low ink sensing system combined with a cartridge detection system which together employ a prism, a mirror, light sources and a photosensor coating such that when a carriage is positioned at a sensing station if a reflected beam is not detected then the cartridge is not present in the carriage.

U.S. Pat. No. 6,467,869 to Merz et al. discloses cartridges with exterior marks arranged to form a pattern that is electronically scanned by a printer to identify and verify that an appropriate cartridge combination has been installed.

U.S. Pat. No. 6,739,689 to Choi discloses an apparatus operable to identify the type of cartridge mounted in a carriage or if any cartridge is present. The apparatus has identifying units, such as protrusions, reflective surfaces or flexible printed circuits with electrical contact node structures, provided on the cartridge body, a sensing unit on the carriage to sense the identifying unit, and a micro processing unit to make the identification by using signals from the sensing unit. The sensing unit includes light sensors in the form of light emitters and detectors or micro switches operated by the protrusions.

U.S. Pat. No. 6,805,430 to Chen et al. discloses an apparatus having a carriage receiving a cartridge, a sensor to detect color of identifiable areas on the cartridge being associated with color of ink in the cartridge, and a control unit to receive a signal from the sensor to determine whether the cartridge is correctly placed in the carriage; if misplaced, a warning signal is generated to alert the user. The sensors and identifiable areas are charge coupled devices or contact image sensors capable of electrically coupling with one another; alternatively, signals between sensors and control unit can be transmitted and received by wireless methods, such as infrared data association, RF transmission or radio transmission.

U.S. Pat. No. 7,125,109 to Watanabe et al. discloses electrical contacts on an ink container and container holder which make electrical connections with one another when the ink container is seated in the container holder.

U.S. Pat. No. 7,157,727 to Kimura discloses an optical detector able to sense presence of a cartridge by using a signal from light sending and receiving parts on the carriage adjacent to the bottom of the cartridge wherein the light can be both refracted and reflected to determine whether the cartridge is present and to determine how much ink is left.

A common drawback of these approaches is that they all require the addition of electrical and/or optical parts that come at a significant and unacceptable increase in cost.

Another approach previously suggested to sense an unseated ink tank without the addition of costly parts is to move the carrier slowly away from the loading position after the cover is closed (after a tank loading or change). Then, if a tank is not fully inserted and seated, this approach assumes it will stall the carrier when the unseated tank interferes with the covers. However, while this approach can be implemented at no increased hardware cost, the assumption that an unseated tank will hit the covers may not be valid. An upper end of an unseated tank, as seen in FIGS. 2 and 3, is not necessarily high enough to interfere with the covers. Also, even if a carrier stall does occur, this approach would provide a system in which a true carrier stall occurring after a tank install is indistinguishable from an improperly installed tank.

Also, it is taught in U.S. Pat. Application Publication No. 2007/0040876 to Anderson et al. whose invention is assigned to the same assignee as the present invention, to use a RFID linking device, such as a RFID tag, on components that are consumable and replaceable, such as ink cartridges or tanks. The RFID tags are employed for purposes of identification to the printer of ink usage, part number, serial number, etc. of the replaceable components. The added cost of usage of these devices is thought to be justified to ensure compatibility between replaceable components and printers so as to maintain high print quality and reliable operation. However, there is no recognition that a RFID linking device might be useful per se in detecting an unseated consumable cartridge or tank or enabled for such use through making a modification to the RFID linking device.

Thus, there is still a need for an innovation that will automatically detect the aforementioned unseated tank condition with minimal added cost to the design of the inkjet printing system.

SUMMARY OF THE INVENTION

The present invention meets this need by providing an innovation that can automatically detect an unseated (and thus also a seated) tank condition with minimal, or at least acceptable added, cost to the design of the inkjet printing system while at the same time not suffer the common drawback of the previously-mentioned approaches. Underlying the innovation of the present invention is the insight by the inventors herein that a RFID linking device can be modified and supplemented to adapt it for automatically detecting an unseated tank condition without affecting its capability to provide its other previously recognized functions. These changes convert the RFID linking device into a switchable sensor with expanded utility at minimal cost and modification to the design of the RFID linking device as well as to the inkjet printing system. By making these changes to it structure, the RFID linking device becomes a switchable sensor provided with a break or make circuit capability in its electrical circuitry which, when implemented on a replaceable tank of a printing system, corresponds or correlates to an unseated or seated condition of the tank with the carrier of the printing system. Furthermore, this innovation is perceived by the inventors herein to have general application involving the use of the switchable sensor in detecting the unseated condition of a first component, having the switchable sensor, with respect to a second component having an element capable of actuating the switchable sensor.

Accordingly, in an aspect of the present invention, a switchable sensor is provided having a RFID linking device and a switchable device integrated with the electrical circuitry of the RFID linking device for switching the RFID linking device between a disabled communicatively unavailable state and an enabled communicatively available state.

In another aspect of the present invention, the electrical circuitry of the RFID linking device of the switchable sensor is modified in the sense that an electrical break or disconnection is made in the electrical circuitry thus providing an electrical and physical separation between two portions of the electrical circuitry which disables the RFID linking device to the communicatively unavailable state.

In a further aspect of the present invention, the electrical circuitry of the RFID linking device of the switchable sensor is supplemented in the sense that the switchable device is integrated with the two physically and electrically separated portions of the electrical circuitry such that the switchable device is exposed and accessible from externally (or from outside) of the switchable sensor and thus capable of being electrically closed and thus switched externally, enabling the RFID linking device from the communicatively unavailable state to the communicatively available state.

In an exemplary embodiment of the switchable sensor of the present invention, the switchable device integrated with the two physically and electrically separated and accessible portions of the electrical circuitry is comprised of two electrically conductive contacts, open with respect to one another, provided on the two portions of the electrical circuitry of the RFID linking device, the two open contacts capable of being electrically and physically closed and thus switched by an external electrically conductive element.

In another exemplary embodiment of the switchable sensor of the present invention, the switchable device integrated with the two physically and electrically separated and accessible portions of the electrical circuitry is comprised of a single-pole-single-throw type switch for spanning the two portions of the electrical circuitry of the RFID linking device, the switch capable of being electrically and physically closed by an external non-conductive element.

In still another aspect of the present invention, a first component has a body, such as one for containing a consumable material, and a RFID linking device-based switchable sensor mounted on the body and normally disabled to the communicatively unavailable state so as to detect the body of the first component in an unseated condition with respect to a second component.

In yet another aspect of the present invention, a switchable sensor system is provided with a RFID linking device mounted on a container component and having electrical circuitry, a switchable device mounted on the container component and integrated with the electrical circuitry of the RFID linking device such that the switchable device normally assumes a first condition disabling the RFID linking device to a communicatively unavailable state in response to the container component being in an unseated condition with respect to a container receiving component, and an actuator mounted on the container receiving component and operable to switch the switchable device to a second condition enabling the RFID linking device to a communicatively available state in response to the container component being placed in a seated condition with the container receiving component.

BRIEF DESCRIPTION OF THE DRAWINGS

Figure 1:
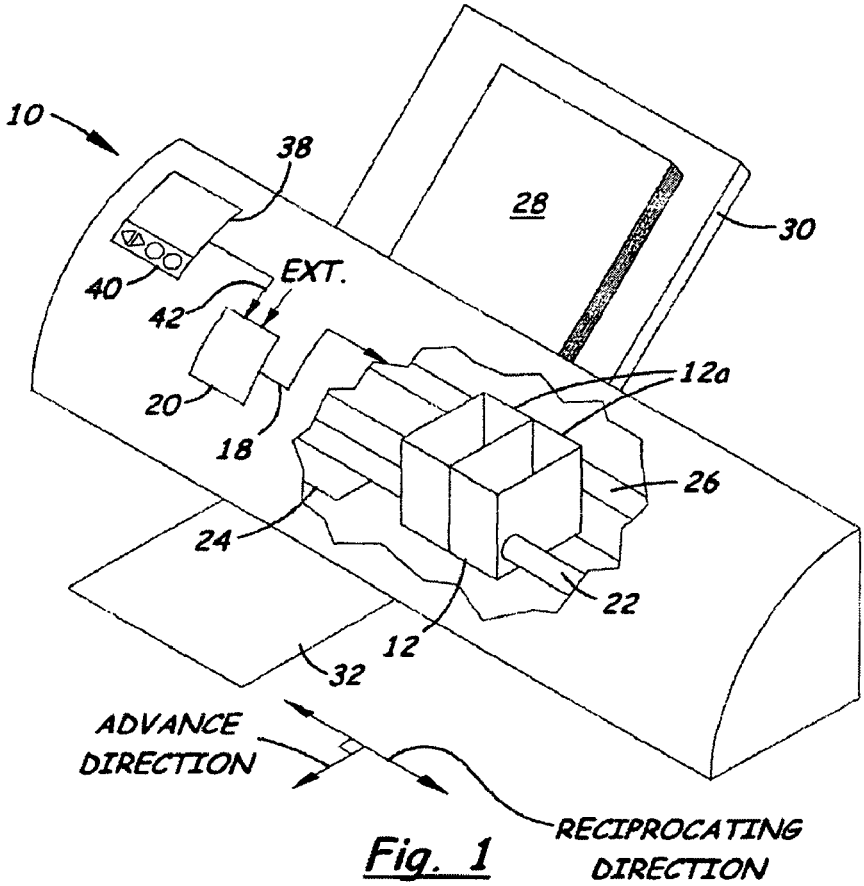
Fig. 1 (PRIOR ART)

Having thus described the invention in general terms, reference will now be made to the accompanying drawings, which are not necessarily drawn to scale, and wherein:

FIG. 1 is a perspective schematic representation of an exemplary embodiment of a prior art inkjet printing system adapted to advantageously employ a RFID linking device-based switchable sensor according to the present invention.

Figure 2:
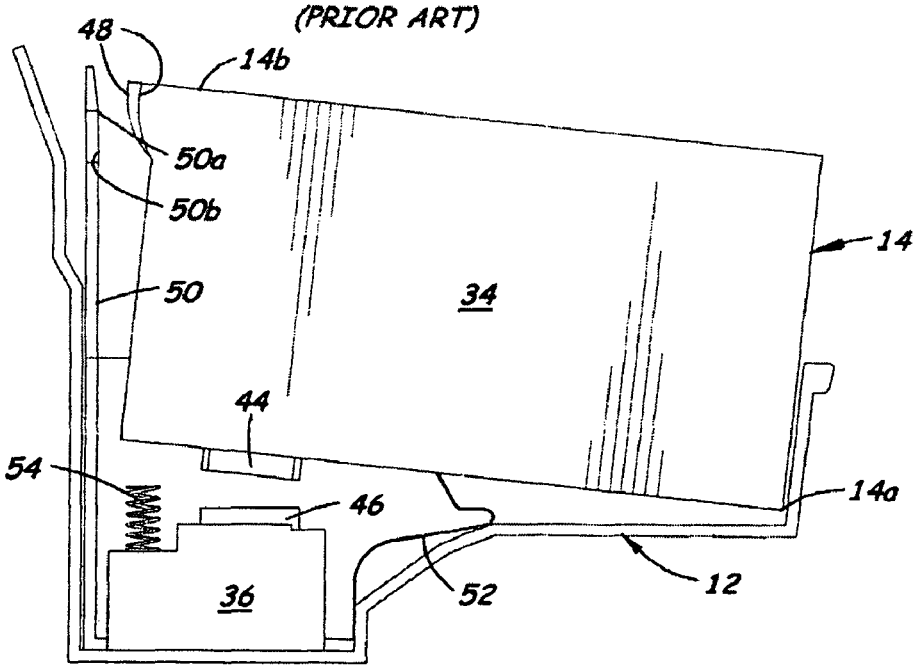
Fig. 2 (PRIOR ART)
Figure 3:
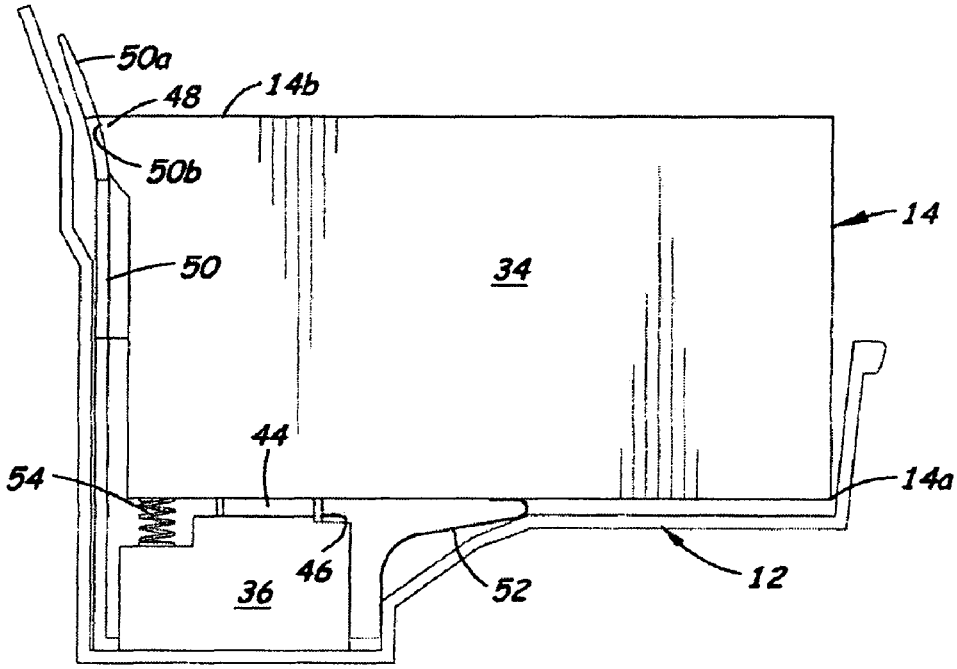
Fig. 3 (PRIOR ART)
Figure 4:
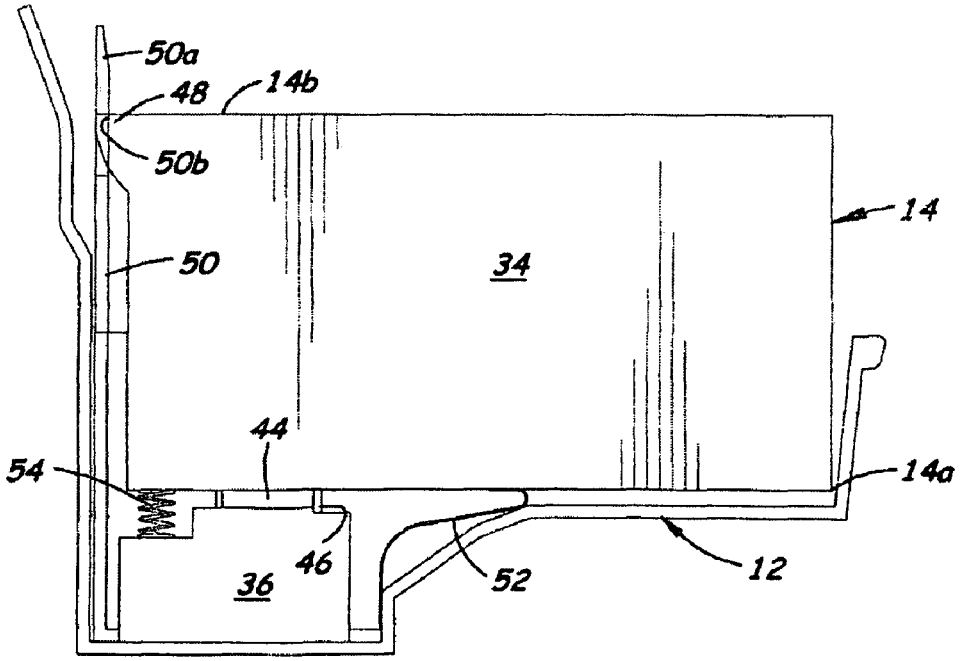
Fig. 4 (PRIOR ART)

FIGS. 2 to 4 are side elevational schematic representations of an ink tank being installed in a carrier, showing the tank in successive positions relative to the carrier and printhead progressing from unseated in FIG. 2, to almost seated in FIG. 3, to fully seated in FIG. 4.

Figure 5:
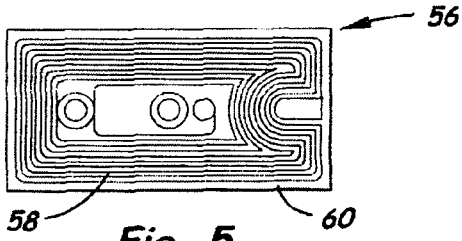
Fig. 5 (PRIOR ART)

FIG. 5 is a plan view of a prior art RFID linking device.

Figure 6:
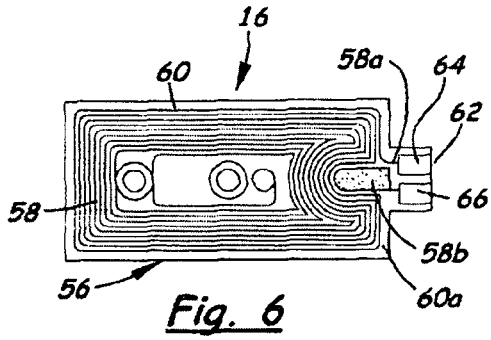

FIG. 6 is a plan view of one modified and supplemented form of the RFID linking device of FIG. 5, providing one exemplary embodiment of the RFID linking device-based switchable sensor of the present invention.

Figure 7:
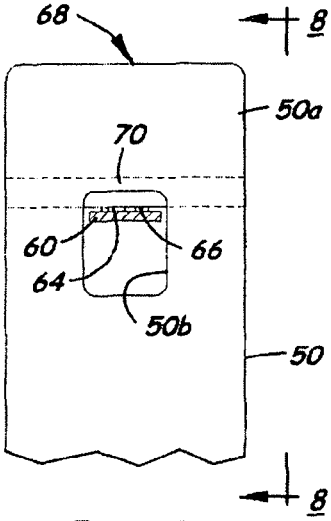

FIG. 7 is a fragmentary front elevational schematic representation of a carrier latch with a conductive element mounted thereon for electrically connecting two electrical contacts of the one exemplary embodiment of the RFID linking device-based switchable sensor of FIG. 6.

Figure 8:
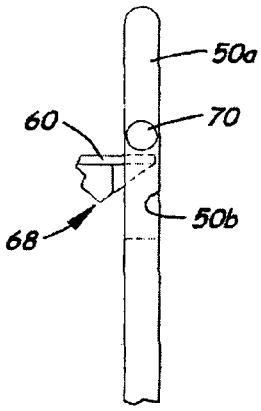

FIG. 8 is a fragmentary side elevational schematic representation of the carrier latch taken along line 8-8 of FIG. 7.

Figure 9:
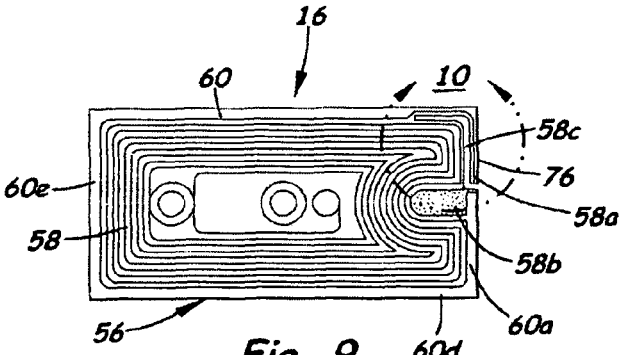

FIG. 9 is a plan view of another modified and supplemented form of the RFID linking device of FIG. 5, providing another exemplary embodiment of the RFID linking device-based switchable sensor of the present invention.

Figure 10:
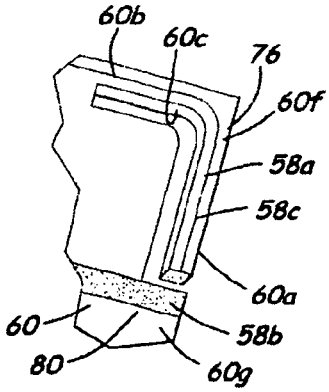

FIG. 10 is an enlarged fragmentary perspective schematic representation of the RFID linking device-based switchable sensor of FIG. 9 showing a flexible member formed at an end portion of the sensor in the area enclosed by circled area 10.

Figure 11:
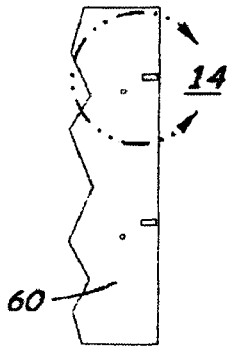
Figure 12:
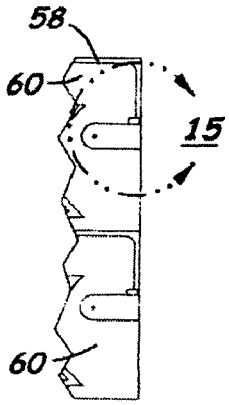
Figure 13:
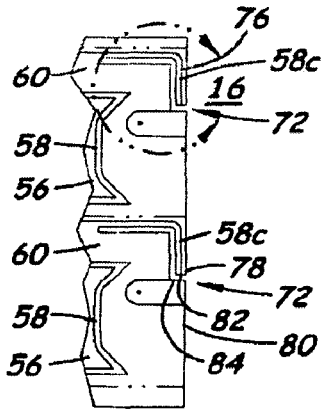

FIGS. 11 to 13 are a series of fragmentary views of successive stages in the fabrication of the RFID linking device-based switchable sensor of FIG. 9.

Figure 14:
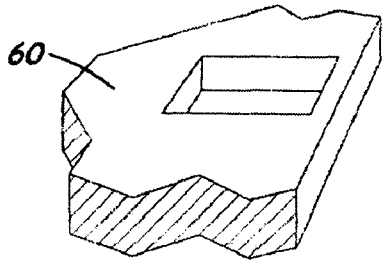
Figure 15:
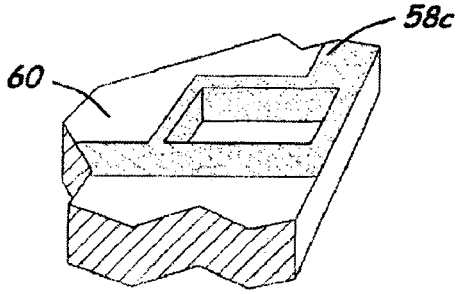
Figure 16:
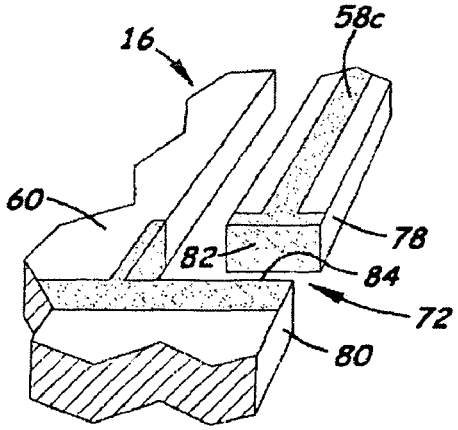

FIGS. 14 to 16 are enlarged fragmentary perspective views of successive stages in the fabrication of the flexible member of the RFID linking device-based switchable sensor of FIG. 9, which views correspond to respective circled areas 14 to 16 in FIGS. 11 to 13.

Figure 17:
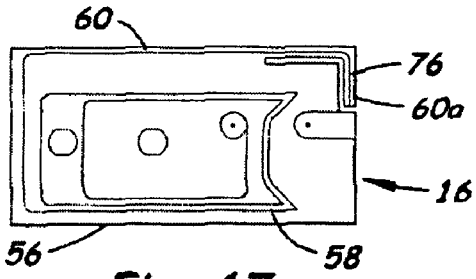

FIG. 17 is a diagrammatic plan view of the RFID linking device-based switchable sensor of FIG. 9.

Figure 18:
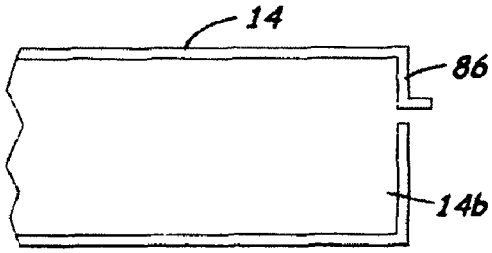

FIG. 18 is a fragmentary diagrammatic plan view of a top portion of an ink tank adjacent to its front end showing a flexible member molded therein which is complementary to the RFID linking device-based switchable sensor of FIG. 9.

Figure 21:
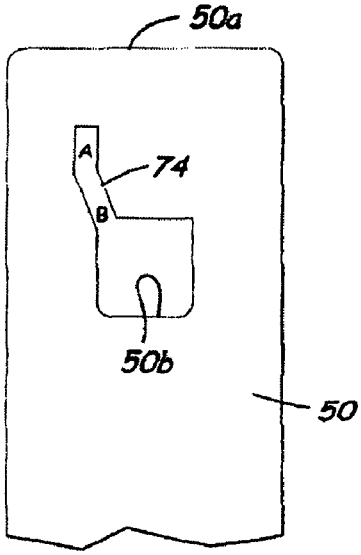
Figure 19:
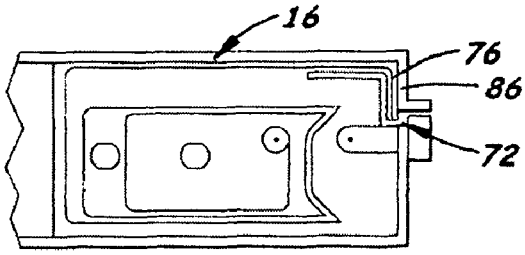

FIG. 19 is a diagrammatic plan view of the RFID linking device-based switchable sensor of FIG. 17 applied on the top front end portion of the ink tank of FIG. 18 showing normal positions of the flexible member of the ink tank and switchable sensor prior to their actuation by the modified carrier latch of FIG. 21.

Figure 20:
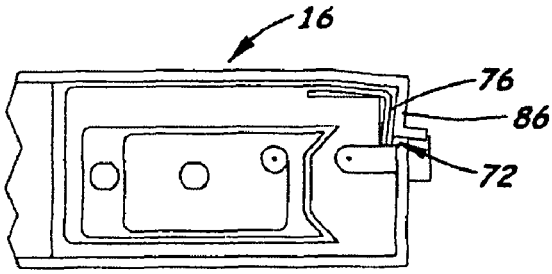

FIG. 20 is a diagrammatic plan view similar to that of FIG. 19 now showing positions of the flexible member of the ink tank and switchable sensor after their actuation by the modified carrier latch of FIG. 21.

FIG. 21 is a fragmentary front elevational schematic representation of a carrier latch with a flexible member guide element formed thereon for physically actuating the flexible members of the ink tank and switchable sensor from the open condition of FIG. 19 to the closed condition of FIG. 20.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

The present invention is illustrated and described in conjunction with a consumable item for an external printing system in which the consumable item and external system are configured to transfer and receive information to and from one another via radio frequency. Since the capability of transferring and receiving of information via radio frequency does not per se enter into any aspects of the present invention, this capability will not be described hereinafter. Also, while the exemplary embodiments of the present invention are illustrated herein in conjunction with ink tanks for inkjet printer technology, as will be apparent to those of ordinary skill in the art the present invention may be employed in other consumable items for print technologies such as print cartridges for inkjet printers, toner cartridges for laser jet printers, ink tanks for fax, photo printers, all-in-one devices, or plotters, or any other device incorporating printing technology, and furthermore as will be apparent to those of ordinary skill in the art the present invention may be employed in other technologies wherein the operational requirement is that one component be in a seated condition with respect to another component and the seated condition needs to be positively ascertained in order to provide assurance that the systems employing such other technologies will operate reliably without risk of damage to them as would be the case by the occurrence of an unseated condition.

Referring now to FIG. 1, there is illustrated a prior art printing system taking the form of an inkjet printer, generally designated 10. The printer 10 includes a printhead carrier 12 having one or more positions 12*a* for receiving and containing one or more ink tanks 14, as seen in FIGS. 2 to 4, on which can be employed a RFID linking device-based switchable sensor 16 of the present invention, as illustrated in two exemplary embodiments in FIGS. 6 and 9. The printhead carrier 12 of the printer 10 reciprocates, in accordance with an output 18 of a controller 20 in the printer 10, along a shaft 22 above a print zone 24 by a motive force supplied to a drive belt 26 as is well known in the art. The reciprocation of the carrier 12 occurs relative to a print medium, such as a sheet of paper 28, that advances in the printer 10 along a paper path from an input tray 30, through the print zone 24, to an output tray 32. As one skilled in the art will appreciate, any carrier movement mechanism may be utilized in the printer 10.

While in the print zone 24, the carrier 12 reciprocates in the reciprocating direction generally perpendicular to the paper 28 being advanced in the advance direction as shown by the arrows. Ink drops from a reservoir body 34 of the ink tank 14 are caused to be ejected from a heater chip (not shown) of a printhead 36, shown schematically in FIGS. 2 to 4, at such times pursuant to commands of a printer microprocessor, such as the controller 20. The timing of the ink drop emissions corresponds to a desired pattern of pixels of the image being printed. While the exemplary embodiments of the present invention illustrated herein will be described with reference to thermal inkjet printhead technology, as will be apparent to those of ordinary skill in the art the present invention may also be employed in or in combination with an inkjet printhead which utilizes other technologies such as pressurized nozzles, electrostatic fields and/or piezoelectric elements.

The printer 10 may also includes a control panel 38 having a user selection interface 40 as found in conventional printers. The control panel 38 may function as an input 42 to the controller 20 to provide additional printer capabilities and robustness. Such a control panel is known to one of ordinary skill in the art and need not be described in detail herein.

The ink tank 14 is a conventional receptacle having its reservoir body 34 configured to hold ink for dispensing during a printing operation. As best seen in FIGS. 2 to 4, the reservoir body 34 of the ink tank 14 is also configured to seat properly in the carrier 12 and interfit with the printhead 36 so as to form a sealed interconnection therewith at their respective tubular spouts 44, 46 so that ink will not leak onto the adjacent mechanisms causing ink loss and evaporation as well where the ink will dry within the carrier printhead 36 causing degradation in print quality. For enabling seating within one of the positions 12*a* of the carrier 12, the reservoir body 34 of the ink tank 14 is provided with a front upper lip 48 which protrudes therefrom and the carrier 12 is provided with an upstanding clip or latch 50 at the front of the position 12*a*. The tank 14 is initially inserted into the position 12*a* of the carrier 12 to the location seen in FIG. 2. Then, by rocking the tank 14 counterclockwise, as viewed in FIGS. 2 to 4, about a fulcrum defined at its rear bottom corner 14*a* and against reaction forces generated by a leaf spring 52 and a coil spring 54 mounted respectively on the bottom of the carrier 12 adjacent to the printhead 36, the upper front protruding lip 48 of the tank 14 is brought into engagement with the upper end portion 50*a* of the latch 50, forcing the resiliently bendable latch 50 to bend away from the tank 14 and allow the lip 48 to slide down the latch 50 and into a slot 50*b* in the latch 50. The upward reaction forces of the springs 52, 54 against the bottom of the tank 14, the resiliency of the latch 50 to return to its normal upstanding unbent position and the protruding configuration of the lip 48 all combine to retain the lip 48 extending through the slot 50*b* in the latch 50, rendering the tank 14 and the latch 50 in a snap fit-like connection or engagement together when the tank 14 is properly seated with respect to the carrier 12 and printhead 36.

FIGS. 2 to 4 show a sequence of successive locations of the tank 14 relative to the carrier 12 and the printhead 36. In FIG. 2, the tank 14 is clearly in an unseated condition with respect to the carrier 12 wherein the lip 48 of the tank 14 is still spaced from the latch 50 and the tubular spouts 44, 46 of the tank 14 and printhead 36 are still spaced apart. In FIG. 3, the tank 14 is almost but not quite in the seated condition wherein its lip 48 has engaged the latch 50 but not yet reached the snap fit point of engagement with it and the tubular spouts 44, 46 of the tank 14 and printhead 36 are not fully interfitted in a sealed ink delivery relationship with one another. In FIG. 4, the tank 14 has finally reached and achieved the seated condition with respect to the carrier 12 and printhead 36 in which the lip 48 is snap fitted with the latch 50 and the tubular spouts 44, 46 of the tank 14 and printhead 36 are interfitted together in the sealed delivery relationship with one another.

Turning now to FIG. 5, there is illustrated a conventional RFID linking device 56, well-known in one prior art form as a RFID tag. Basically, the RFID linking device 56 includes electrical circuitry 58 (having various electronic components included therewith which are not necessary to specifically describe herein). The REID linking device 56 has the capability to perform certain desired functions, such as to identify to the printer the ink usage, part number, serial number. etc. of the replaceable components. These functions are recognized in U.S. Pat. Application Publication No. 2007/0040876 (also identified as U.S. application Ser. No. 11/208,814) by Anderson et al. and assigned to the same assignee as that of the subject application, Lexmark International, Inc. The disclosure of this prior application is hereby incorporated by reference. As described therein, an illustrative example of a RFID tag that is known in the prior art is one marketed by Texas Instruments, identified as part number RI-I11-112A. In addition, U.S. Pat. No. 3,713,148 to Cardullo and U.S. Pat. No. 4,384,288 to Walton describe the makeup of RFID linking devices. The disclosures of these patents are hereby incorporated by reference.

As is well-known and described in these patents, the RFID linking device 56 typically performs a passive transponder function in an interrogation-transponder system. In regard to the printing system of FIG. 1, a second RFID linking device can be provided on the printer 10 or provided remote therefrom to perform the interrogator function when a new replaceable component is installed in the printer 10. Thus, the RFID linking device 56 would normally be in a passive mode in which it is "enabled" and stands "communicatively available" to receive an interrogation signal from the second RFID linking device and to respond to the interrogation signal by sending the identification data about the new component stored in its memory.

Turning now to FIG. 6, there is illustrated a first exemplary embodiment of the RFID linking device-based switchable sensor 16 of the present invention, whose application on the tank 14, along with another cooperative element on the latch 50 of the carrier 12, permits the detection of the tank 14 in an unseated condition with respect to the carrier 12. Such detection function was not known heretofore as one associated with the conventional RFID linking device 56 of FIG. 5. As will be explained hereinafter, the RFID linking device 56 is modified and supplemented so as to provide the switchable sensor 16 of the present invention adapted for automatically detecting an unseated tank condition without affecting the capability of the RFID linking device 56 incorporated by the switchable sensor 16 to perform the other functions it did before the modification.

The modification that is made in the RFID linking device 56 of FIG. 5 is the incorporation of a break or disconnection in its electrical circuitry 58 so as to provide two portions 58*a*, 58*b* of the electrical circuitry 58 that are electrically and physically separated from one another. The RFID linking device 56 also includes a suitable substrate 60, such as a thin two-sided glass/epoxy circuit board. The supplementation or addition which converts this RFID linking device 56 into the switchable sensor 16 of FIG. 6, or FIG. 9, is the incorporation or integration of a switchable device 62 with the two portions 58*a*, 58*b* of the electrical circuitry 58 on the substrate 60. The incorporation of a break or make circuit switchable capability of the switchable device 62 with the electrical circuitry 58 of the RFID linking device 56 expands the utility of the resulting RFID linking device-based switchable sensor 16 at minimal cost and minimal change to the design of the conventional RFID linking device 56, as well as to the inkjet printing system.

This break or make circuit switchable capability incorporated by the RFID linking device-based switchable sensor 16 now "disables" or "enables" the RFID linking device 56 and thus the switchable sensor 16 to correspondingly "communicatively unavailable" or "communicatively available" states for responding to interrogation. The switchable device 62 thus normally assumes a first, open electrical circuit condition. This open circuit condition disables the RFID linking device 56 such that it is now normally in a communicatively unavailable state in which it is non-responsive to interrogations. The switchable device 62 is electrically and physically accessible externally and thus capable of being electrically and physically switched from externally of the switchable device 62 from the first open electrical circuit condition to a second closed electrical circuit condition enabling the RFID linking device 56 to a communicatively available state in which it is responsive to interrogations. These states further correspond or correlate with the tank 14 being in an "unseated condition" or "seated condition" with respect to the carrier 12 of the inkjet printing system. The RFID linking device-based switchable sensor 16 is also thought to be useful for detecting, in general, an unseated condition of a first component with respect to a second component.

More particularly, in the exemplary embodiment of the RFID linking device-based switchable sensor 16 shown in FIG. 6, the switchable device 62 is comprised of two electrically conductive contacts 64, 66 mounted on the substrate 60 and physically and electrically connected to the two portions 58*a*, 58*b* of the electrical circuitry 58. In its application to the printing system, the switchable sensor 16 is mounted on the top of the tank 14 with its switchable device 62 adjacent to the upper front edge 14*b* thereof (such as overlying the front upper lip 48 of the tank body 34 in FIGS. 2 to 4). The two contacts 64, 66 are electrically and physically connected respectively to the two portions 58*a*, 58*b* of the electrical circuitry 58 but not electrically nor physically connected to one another since in the first condition, as defined above, the switchable device 62 is open and non-conductive and thus the RFID linking device 56 is disabled to the communicatively unavailable state and thus non-responsive to interrogation. However, the two contacts 64, 66 are exposed and accessible from externally of the switchable device 62 and the substrate 60 and thus are capable of being electrically and physically connected to one another from externally of the switchable device 62 and the substrate 60. The electrically conductive contacts 64, 66 also project from the two portions 58*a*, 58*b* of the electrical circuitry 58 of the RFID linking device 56 and are in the form of contact pads 64, 66 applied on a forward edge portion 60*a* of the substrate 60, as seen in FIG. 6.

The RFID linking device-based switchable sensor 16, as just described, is thus provided on a component, such as an ink tank 14, which is intended to be placed in a seated condition to enable its proper use in the printing system. For achieving this function, the RFID linking device-based switchable sensor 16 is a part of an overall switchable sensor system 68, as seen in FIGS. 6 to 8, in which an actuator 70 is mounted on a second, receiving component, such as the carrier 12, that receives and snap fits with the first container component, such as the tank 14. In the first exemplary embodiment of the switchable sensor system 68, the actuator 70 functions as an electrical shorting member for shorting the two contacts 64, 66. The actuator 70 thus is a structure that is operable to physically contact, short and thus switch the previously described switchable device 62 of the switchable sensor 16 to the second electrically closed circuit condition, enabling the RFID linking device 56 to the communicatively available state and thus accessible to interrogation.

As seen in FIGS. 7 and 8, the actuator 70 can take the form of an electrically conductive element, such as a piece of gold plated wire stock, disposed across the slot 50*b* of the latch 50 such that the two contacts 64, 66 will be brought into contact with the actuator 70 when the tank 14 is placed in its seated condition at position 12*a* with respect to the carrier 12. As an alternative, the latch 50 could be made of a metal and so act as the actuator 70 in shorting the two contacts 64, 66 when the tank 14 is seated and latched in the position 12*a* by the latch 50. Thus, the RFID linking device 56 will be enabled to the communicatively available state and perform its transponder function only in response to the container component, the tank 14, being placed in the seated condition with respect to the container receiving component, the carrier 12, or the condition shown in FIG. 4. In the printer system of FIG. 1, an RFID station might be utilized where each new tank 14 is checked and where a seated tank responds properly but an unseated tank does not. The station will then display an alert to the user with the identity and location of the one or more unseated tanks.

Turning now to FIGS. 9, 10, 13, and 16, there is illustrated a second exemplary embodiment of the RFID linking device-based switchable sensor 16 of the present invention, whose application, like in the first exemplary embodiment, on the tank 14, along with another cooperative element on the latch 50 of the carrier 12, permits the detection of the tank 14 in an unseated condition with respect to the carrier 12. The switchable device 62 of the switchable sensor 16 in the second exemplary embodiment is a single-pole-single-throw switch 72 supported on the substrate 60 and electrically and physically connected to the two portions 58*a*, 58*b* of the electrical circuitry 58 but not electrically nor physically actuated in its first condition. The single-pole-single-throw switch 72 is placed at the one end 60*a* of the substrate 60 and is exposed and thus accessible from externally of the switchable sensor 16 and thus capable of being electrically and physically actuated by a cooperative element, such as an electrically non-conductive actuator 74, as seen in FIG. 21, formed on the latch 50 of the carrier 12. Such actuation of the switch 72 electrically and physically switches RFID linking device 56 from the disabled, communicatively unavailable state where it is non-responsive to interrogation, to the enabled, communicatively available state where it is responsive to interrogation.

More particularly, still referring to FIGS. 9, 10, 13 and 16, the substrate 60 has a pair of opposite surfaces 60*b*, 60*c*, a pair of opposite ends 60*d*, 60*e*, and first and second marginal edge portions 60*f*, 60*g* defined adjacent to the one end 60*d*. The electrical circuitry 58 of the RFID linking device 56 is applied on the one surface 60*b* of the substrate 60 such that a conductive segment 58*c* of the electrical circuitry 58 runs on the one surface 60*b* along the first and second marginal edge portions 60*f*, 60*g* of the substrate 60, adjacent to the one end 60*d* thereof. The first marginal edge portion 60*f* of the substrate 60 is configured to form a flexible member 76 in the substrate 60 which has a movable terminal end 78 adjacent to but spaced from a stationary terminal end 80 defined on the second marginal edge portion 60*g*. The two portions 58*a*, 58*b* of the electrical circuitry 58 are defined by the conductive segment 58*c* which, due to the formation of the flexible member 76 in the first and second marginal edge portions 60*f*, 60*g* of the substrate 60, is formed, in two parts. The two portions 58*a*, 58*b* of the conductive segment 58*c* are provided electrically and physically separate from one another and applied respectively on the movable and stationary terminal ends 78, 80 so as to form, in conjunction with the flexible member 76, a pair of movable and stationary electrical terminal end contacts 82, 84 of the single-pole-single-throw switch 72 being in an electrically and physically open circuit condition disabling the RFID linking device 56 to the communicatively unavailable state. The switch 72 is capable of being closed enabling the RFID linking device 56 to a communicatively available state in response to the flexible member 76 being flexed so as to bring the movable electrical terminal end contact 82 on the flexible member 76 into physical contact with the stationary electrical terminal end contact 84 on the second marginal edge portion 60*g* of the substrate 60.

The RFID linking device 56 with the switch 72 of the switchable sensor 16 can be constructed using the same techniques as are used in the construction of the standard RFID tag. The switchable sensor 16 is constructed on a thin two-sided glass/epoxy circuit board with plated through holes and signal traces plated with gold. Layout and construction of the board are modified to provide one of the two additional contacts 82, 84 on the flexible member 76. FIGS. 11 to 16 show the typical steps that are applied to produce the contacts 82, 84 and the flexible member 76 of the switch 72. In FIGS. 11 and 14, a blank circuit board is plated with copper, drilled, routed and plated through holes. In FIGS. 12 and 15, the board is solder masked and the circuitry etched. In FIGS. 13 and 16 the final routing and drilling is done.

FIGS. 17 to 21 illustrate the modifications to the tank 14 and latch 50 and the assembly of the second exemplary embodiment of the switchable sensor 16, shown in FIG. 17, on the tank 14. The tank 14 is modified to include a molded flexible member 86 on its upper front edge 14*b*, as shown in FIG. 18, which is complementary to the flexible member 76 of the switch 72. The switchable sensor 16 is mounted to the top of the tank 14 adjacent to its front edge 14*b* and near the location of the retaining clip or latch 50 on the carrier 12, and the flexible member 76 of the switch 72 on the switchable sensor 16 is mated to the flexible member 86 on the tank 14, as shown in FIG. 19. The normal positions of the flexible members 76, 86 of the switch 72 and tank 14, prior to their actuation by the modified carrier latch 50 of FIG. 21, are shown in FIG. 19. FIG. 20 is similar to FIG. 19 but now showing positions of the flexible members 76, 86 of the switch 72 and tank 14 after their actuation by the modified carrier latch 50 of FIG. 21. The tank retaining carrier clip or latch 50, as seen in FIG. 21, is modified to include an actuator 74 in the form of a guide path that actuates the tank flexible member 86 from position A (also its position seen in FIG. 19) to position B (also its position seen in FIG. 20), and thus correspondingly the switch flexible member 76 as the tank 14 is fully seated into the position 12*a* in the carrier 12.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A switchable sensor for an imaging device configured to use consumable items, including a print cartridge, the print cartridge for mating with a mounting structure in the imaging device during use, comprising:

a RFID linking device configured on one of the print cartridge or mounting structure and having electrical circuitry with two portions being electrically and physically separated from one another; and a switchable device configured on a same said one of the print cartridge or mounting structure and integrated with said two portions of said electrical circuitry of said RFID linking device so as to normally assume a first condition disabling said RFID linking device to a communicatively unavailable state, said switchable device being electrically and physically accessible externally and capable of being electrically and physically switched from said first condition to a second condition enabling said RFID linking device to a communicatively available state by an actuator configured on the other said one of the print cartridge or mounting structure, said actuator electrically completing the electrical circuitry upon the proper mating of the print cartridge to the mounting structure, otherwise the electrical circuitry remaining said electrically and physically separated if the print cartridge and mounting structure are improperly mated.

2. The switchable sensor of claim 1 wherein said RFID linking device is a RFID tag.

3. The switchable sensor of claim 1 wherein said switchable device comprises:

two electrically conductive contacts electrically and physically connected respectively to said two portions of said electrical circuitry but not electrically nor physically connected to one another in said first condition, said contacts being accessible from externally of said switchable device and thus capable of being electrically and physically connected to one another from externally of said switchable device by said actuator to thereby electrically and physically switch said RFID linking device from said disabled communicatively unavailable state to said enabled communicatively available state.

4. The switchable sensor of claim 1 wherein said switchable device comprises:

a single-pole-single-throw type switch electrically and physically connected to said two portions of said electrical circuitry but not electrically nor physically actuated in said first condition, said single-pole-single-throw type switch being accessible from externally of said switchable device and thus capable of being electrically and physically actuated from externally of said switchable device by said actuator to thereby electrically and physically switch said RFID linking device from said disabled communicatively unavailable state to said enabled communicatively available state.

5. The switchable sensor of claim 1 wherein said RFID linking device includes an electrically non-conductive substrate, said electrical circuitry mounted on said substrate.

6. The switchable sensor of claim 5 wherein said switchable device comprises:

two electrically conductive contacts mounted on an extended portion of said substrate and electrically and physically connected respectively to said two portions of said electrical circuitry but not electrically nor physically connected to one another in said first condition, said contacts being accessible from externally of said switchable device and said substrate and thus capable of being electrically and physically connected to one another from externally of said switchable device and said extended portion of the substrate by said actuator to thereby electrically and physically switch said RFID linking device from said disabled communicatively unavailable state to said enabled communicatively available state.

7. The switchable sensor of claim 6 wherein said pair of electrically conductive contacts also project from said RFID linking device on the extended portion of the substrate.

8. The switchable sensor of claim 5 wherein said switchable device comprises:

a single-pole-single-throw type switch mounted on said substrate and electrically and physically connected to said two portions of said electrical circuitry but not electrically nor physically actuated in said first condition, said single-pole-single-throw type switch being accessible from externally of said switchable device and thus capable of being electrically and physically actuated from externally of said switchable device by said actuator to thereby electrically and physically switch said RFID linking device from said disabled communicatively unavailable state to said enabled communicatively available state.

9. The switchable sensor of claim 8 wherein:

said substrate has a pair of opposite surfaces, a pair of opposite ends, and first and second marginal edge portions adjacent to one of said opposite ends;

said electrical circuitry of said RFID linking device is applied on one of said opposite surfaces of said substrate such that a conductive segment of said electrical circuitry is applied on said one opposite surface along said first and second marginal edge portions of said substrate adjacent to said one of said opposite ends thereof;

said first of said marginal edge portions of said substrate is configured to form a flexible member having a movable terminal end adjacent to but spaced from a stationary terminal end on said second of said marginal edge portions such that two portions of said conductive segment of said electrical circuitry of said RFID linking device are provided electrically and physically separated from one another and applied respectively on said movable and stationary terminal ends so as to form, in conjunction with said flexible member, a pair of movable and stationary electrical terminal end contacts of said single-pole-single-throw type switch being in an electrically and physically open condition disabling said RFID linking device to a communicatively unavailable state; and said single-pole-single-throw type switch is capable of being closed enabling said RFID linking device to a communicatively available state in response to said flexible member being flexed by said actuator so as to bring said movable electrical terminal end contact on said flexible member into physical contact with said stationary electrical terminal end contact on said second marginal edge portion of said substrate.

10. A print cartridge for placement in a seated condition with respect to a mounting structure of an imaging device, said print cartridge, comprising:

a housing body configured for containing contents consumed by the imaging device during use;

a RFID linking device mounted on said body and having electrical circuitry with two portions being electrically and physically separated from one another; and a switchable device mounted on said body and integrated with said two portions of said electrical circuitry of said RFID linking device so as to normally assume a first condition disabling said RFID linking device to a communicatively unavailable state in response to said print cartridge being in an unseated condition with respect to the mounting structure of the imaging device, said switchable device being electrically and physically accessible externally and capable of being electrically and physically switched from said first condition to a second condition enabling said RFID linking device to a communicatively available state in response to said print cartridge being placed in a seated condition with respect to the mounting structure of the imaging device.

11. The print cartridge of claim 10 wherein said RFID linking device is a RFID tag.

12. The print cartridge of claim 10 wherein said housing body is also configured for containing ink or toner for consumption in the imaging device.

13. The print cartridge of claim 10 wherein said switchable device comprises:

two electrically conductive contacts mounted on said body and electrically and physically connected respectively to said two portions of said electrical circuitry but not electrically and physically connected to one another in said first condition, said contacts being accessible from externally of said switchable device and said body and thus capable of being electrically and physically connected to one another from externally of said switchable device and said body to thereby electrically and physically switch said RFID linking device from said disabled communicatively unavailable state to said enabled communicatively available state in response to said print cartridge being placed in a seated condition with respect to the mounting structure of the imaging device.

14. The print cartridge of claim 10, wherein said switchable device comprises:

a single-pole-single-throw type switch mounted on said body and electrically and physically connected to said two portions of said electrical circuitry but not electrically nor physically actuated to said first condition, said single-pole-single-throw type switch being accessible from externally of said switchable device and said body and thus capable of being electrically and physically actuated from externally of said switchable device and said body to thereby electrically and physically switch said RFID linking device from said disabled communicatively unavailable state to said enabled communicatively available state in response to said print cartridge being placed in a seated condition with respect to said mounting structure of the imaging device.

15. The print cartridge of claim 10 wherein said RFID linking device includes an electrically non-conductive substrate, said electrical circuitry mounted on said substrate.

16. The print cartridge of claim 15 wherein said switchable device comprises:

two electrically conductive contacts mounted on said substrate and electrically and physically connected respectively to said two portions of said electrical circuitry but not electrically nor physically connected to one another in said first condition, said contacts being accessible from externally of said switchable device and said substrate and thus capable of being electrically and physically connected to one another from externally of said switchable device and said substrate to thereby electrically and physically switch said RFID linking device from said disabled communicatively unavailable state to said enabled communicatively available state.

17. The print cartridge of claim 16 wherein said pair of electrically conductive contacts also project from said RFID linking device.

18. The print cartridge of claim 15 wherein said switchable device comprises:

a single-pole-single-throw type switch mounted on said substrate and electrically and physically connected to said two portions of said electrical circuitry but not electrically nor physically actuated in said first condition, said single-pole-single-throw type switch being accessible from externally of said switchable device and thus capable of being electrically and physically actuated from externally of said switchable device to thereby electrically and physically switch said RFID linking device from said disabled communicatively unavailable state to said enabled communicatively available state.

19. The print cartridge of claim 18 wherein:

said substrate has a pair of opposite surfaces, a pair of opposite ends, and first and second marginal edge portions adjacent to one of said opposite ends;

said electrical circuitry of said RFID linking device is applied on one of said opposite surfaces of said substrate such that a conductive segment of said electrical circuitry is applied on said one opposite surface along said first and second marginal edge portions of said substrate adjacent to said one of said opposite ends thereof;

said first of said marginal edge portions of said substrate is configured to form a flexible member having a movable terminal end adjacent to but spaced from a stationary terminal end on said second of said marginal edge portions such that two portions of said conductive segment of said electrical circuitry of said RFID linking device are provided electrically and physically separate from one another and applied respectively on said movable and stationary terminal ends so as to form, in conjunction with said flexible member, a pair of movable and stationary electrical terminal end contacts of said single-pole-single-throw type switch being in an electrically and physically open condition disabling said REID linking device to a communicatively unavailable state; and said single-pole-single-throw type switch is capable of being closed enabling said RFID linking device to a communicatively available state in response to said flexible member being flexed so as to bring said movable electrical terminal end contact on said flexible member into physical contact with said stationary electrical terminal end contact on said second marginal edge portion of said substrate.

20. A switchable sensor system in combination with a container component for holding a consumable material and a container receiving component, said switchable sensor system comprising:

a RFID linking device mounted on said container component and having electrical circuitry with two portions being electrically and physically separated from one another, the container component configured for placement in a seated condition with respect to the container receiving component;

a switchable device mounted on said container component and integrated with said two portions of said electrical circuitry of said RFID linking device so as to normally assume a first condition disabling said RFID linking device to a communicatively unavailable state in response to said container component being in an unseated condition with respect to said container receiving component, said switchable device being electrically and physically accessible from externally of said switchable device and said container component and capable of being electrically and physically switched from said first condition to a second condition enabling said RFID linking device to a communicatively available state; and an actuator mounted on said container receiving component and operable to physically contact and switch said switchable device to said second condition enabling said RFID linking device to said communicatively available state in response to said container component being placed in said seated condition with respect to said container receiving component.

* * * * *